US009712913B2

(12) United States Patent
Lembacher et al.

(10) Patent No.: US 9,712,913 B2
(45) Date of Patent: Jul. 18, 2017

(54) ACOUSTIC SOUND ADSORPTION MATERIAL HAVING ATTACHED SPHERE MATRIX

(71) Applicant: Sound Solutions International Co., Ltd., Beijing, OT (CN)

(72) Inventors: Christian Lembacher, Gramatneusiedl (AT); William A. Ryan, Elgin, IL (US); Heribert Bauer, Siegendorf (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days.

(21) Appl. No.: 15/130,138

(22) Filed: Apr. 15, 2016

(65) Prior Publication Data

US 2016/0309254 A1 Oct. 20, 2016

Related U.S. Application Data

(60) Provisional application No. 62/148,481, filed on Apr. 16, 2015, provisional application No. 62/148,495, filed on Apr. 16, 2015, provisional application No. 62/148,507, filed on Apr. 16, 2015.

(51) Int. Cl.
*H04R 1/28* (2006.01)
*H04R 1/22* (2006.01)

(52) U.S. Cl.
CPC ..... *H04R 1/288* (2013.01); *H04R 1/222* (2013.01); *H04R 1/28* (2013.01); *H04R 1/2803* (2013.01); *H04R 1/2873* (2013.01); *H04R 1/2876* (2013.01); *H04R 2499/11* (2013.01)

(58) Field of Classification Search
CPC ..... H04R 1/288; H04R 1/222; H04R 1/28; H04R 1/2803; H04R 1/2873; H04R 1/2876
USPC ..... 181/151; 381/345, 346, 354
See application file for complete search history.

(56) References Cited

U.S. PATENT DOCUMENTS

| | | | | |
|---|---|---|---|---|
| 7,743,880 | B2 * | 6/2010 | Matsumura | B61D 17/185 181/151 |
| 8,767,998 | B2 * | 7/2014 | Imamura | H04R 1/2803 381/349 |
| 2007/0165895 | A1 * | 7/2007 | Matsumura | H04R 1/2803 381/351 |
| 2009/0245562 | A1 * | 10/2009 | Saiki | H04R 1/2803 381/345 |

(Continued)

FOREIGN PATENT DOCUMENTS

| | | | |
|---|---|---|---|
| EP | 2003924 | A1 | 12/2008 |
| EP | 2424270 | A1 | 2/2012 |

OTHER PUBLICATIONS

International Search Report and Written Opinion dated, Sep. 16, 2016, issued in PCT/MY2016/050024.

*Primary Examiner* — Jeremy Luks
(74) *Attorney, Agent, or Firm* — Steven McMahon Zeller; Dykema Gossett PLLC

(57) ABSTRACT

A gas adsorbing material is provided. Specifically, there is provided a molded matrix of a plurality of spherically-shaped gas adsorbing material. The individual spheres comprise particles of a highly porous gas adsorbing material and a binder. The plurality of spheres are mixed with a second binder material and molded into a desired shape for use in the back volume of an acoustic transducer such as a loudspeaker device, a microphone or a balanced armature receiver.

13 Claims, 9 Drawing Sheets

(56) References Cited

U.S. PATENT DOCUMENTS

| | | | | |
|---|---|---|---|---|
| 2010/0034411 | A1 | 2/2010 | Mellow et al. | |
| 2010/0074463 | A1* | 3/2010 | Fukunishi | H04R 1/2803 381/386 |
| 2010/0206658 | A1* | 8/2010 | Slotte | H04R 1/225 181/151 |
| 2010/0329498 | A1* | 12/2010 | Rouvala | H04R 1/288 381/354 |
| 2012/0063627 | A1* | 3/2012 | Takashima | B82Y 30/00 381/346 |
| 2013/0170687 | A1* | 7/2013 | Papakyriacou | B01J 20/18 381/338 |
| 2014/0037119 | A1* | 2/2014 | Yuasa | H04R 1/02 381/346 |
| 2015/0072723 | A1 | 3/2015 | Schoffmann et al. | |

* cited by examiner

ACOUSTIC SOUND ADSORPTION MATERIAL HAVING ATTACHED SPHERE MATRIX

BACKGROUND OF THE INVENTION a. Field of the Invention

The invention relates to the field of acoustic transducers generally, and specifically to a gas adsorber material for use in acoustic transducers.

b. Background Art

The use of porous materials as gas adsorber in loudspeakers to reduce the resonant frequency and/or to virtually enlarge the back volume (i.e., the space behind the loudspeaker diaphragm) is known in the prior art. Adsorbency is a property of a material that causes molecules, either solid or liquid, to accumulate on the surface of the material. The number of molecules adsorbed depends on both the concentration of molecules surrounding the adsorbent material and the surface area of the adsorbent material. An increase in the concentration of molecules surrounding the adsorbent material results in an increase in the number of molecules adsorbed. Similarly, an increase in the surface area also results in a larger number of molecules being adsorbed. An increase in the adsorbency of a gas adsorber located in a loudspeaker back volume will result in a greater reduction of the resonant frequency and/or a greater virtual enlargement of the back volume, providing greater acoustic performance to the loudspeaker.

The technique of virtually enlarging the back volume of a loudspeaker by using a gas adsorber is particularly useful in mobile devices such as mobile telephones, tablets and laptops where the space available as a loudspeaker back volume can be extremely limited. As more features and capabilities are added to mobile devices, the available space for use as a loudspeaker back volume is more scarce. The known methods of the prior art do not provide sufficient adsorbency for the decreased back volume sizes in some newer mobile devices. Further, there is a desire to provide mobile devices having loudspeakers with improved acoustic performance. An increased adsorbency of the gas adsorber material used in the back volume will allow the size of the back volume to be reduced without a reduction in acoustic performance. Alternatively, for a fixed back volume size, an increase in the adsorbency can improve a loudspeaker's acoustic performance.

Various porous materials and different configurations have been used as a gas adsorber material in a loudspeaker back volume to improve the acoustic performance of the loudspeaker. For example, U.S. Pat. No. 4,657,108 teaches the use of activated charcoal granules in a loudspeaker. U.S. Pat. Publ. No. 2011/0048844 A1, the entire disclosure of which is hereby incorporated by reference, also discloses the use of activated charcoal as well as other highly porous materials including Silica, $SiO_2$, $Al_2O_3$, Zirconia $ZrO_3$, Magnesia (MgO), carbon nanotubes and fullerene. Still further, U.S. Pat. Publ. No. 2013/0170687 A1 discloses the use of a zeolite material having a silicon to aluminum mass ratio of at least 200.

Loose particles of various porous materials, in powder or fiber form, have been used as gas adsorber materials in loudspeaker back volumes to improve acoustic performance. However, using powders and fibers gives rise to a number of problems. For example, electrically conductive materials, such as activated carbon, can cause shorts if the particles get into the surrounding electrical circuits. Loose powder or fiber can also be displaced by sound waves, reducing the overall adsorption effect of the material. Loose debris can also clog acoustic units and block air paths. Furthermore, certain noble porous material can cause corrosion of metal parts that it may come in contact with, such as the metal housing of a device.

Various methods and structures to overcome the problems of using loose particles of porous material have been developed. For example, U.S. Pat. Publ. No. 2011/0048844 A1 discloses the use of a woven or non-woven fabric made of hydrophobic material to support particles of a porous material such as activated carbon. The fabric container is flexible and can be made to fit in a variety of different spaces. However, such a fabric container does not always provide the optimal amount of gas adsorbing material that can fit within a given volume in a loudspeaker.

U.S. Pat. Publ. No. 2013/0341118 A1 discloses a container for holding a porous material, where the container has at least one wall made of a sound transparent material, such as a filter. The container can have a predetermined three-dimensional shape, such as to conform to the available space within the back volume of a loudspeaker enclosure inside a mobile device, with one wall being made from the sound transparent material to allow for the transfer of sound to the gas adsorption material inside the container.

Whether used in a container or not, one issue faced with the using loose particles of a gas adsorbing material is that the particles can become compacted against each other, impeding any airflow between the particles. This can inhibit air from reaching the surfaces of the particles on the inside of a mass of particles, decreasing the amount of overall surface area exposed to the air inside the back volume.

An issue with employing a container for the gas adsorber is that the packaging itself must utilize some of the available space inside the loudspeaker back volume. Since adsorbency is increased with more surface area exposed to the air, it is desirable to place as much of the gas adsorbing material in the back volume as possible. Thus, attempts have been made to provide a gas adsorbing material in the back volume without the need for a container, while also addressing the problems associated with loose particles.

In the context of large conventional speaker systems, European Pat. Publ. No. EP2003924 A1 attempts to address the problems of compacted loose particles. Disclosed therein is a molded gas adsorber obtained by adding a binder to a plurality of particles of activated carbon, thereby forming widened spaces between the particles of the porous material as compared to a conventional gas adsorber with no binder. The size of the particles is quite large at about 0.5 mm in diameter. The binder is provided in the form of a powdery resin material or a fibrous resin material. The plurality of particles and binder can be molded into any shape.

U.S. Pat. Publ. No. 2013/0170687 A1, the entire disclosure of which is herein incorporated by reference in its entirety, discloses a gas adsorbing material comprised of a plurality of zeolite particles adhered together by a binder to form grains of a zeolite material. The spacing between particles within the grains can be established by the binder and processing of the material. The zeolite particles are much smaller than the activated carbon particles, having a mean diameter below 10 micrometer. The average size of the grains of zeolite material is in the range between 0.2 millimeter and 0.9 millimeter. The resulting grains of zeolite material are large enough to allow for better physical handling over the use of the material in loose particle form and can be molded into convenient shapes for handling. An exemplar of such a gas adsorbing material is utilized in the N'Bass™ Virtual Back Volume Technology of Knowles Corporation. Several different miniaturized loudspeaker models incorporating the N'Bass™ technology are commercially available from Knowles.

Spherically shaped grains of zeolite material provide particular advantages in handling, packaging and space utilization. For example, spherical shaped grains of zeolite material have been added to the containers disclosed in U.S. Pat. Publ. No. 2013/0341118, resulting in more adsorbent material, and more surface area, being provided in a back volume than with other grain shapes. Spherically shaped grains of a zeolite material have also been directly filled into the back volume space of a loudspeaker device. The spherical shape particularly allows the grains to be "poured" into an opening in the back volume, which is then sealed after filling. While this method has obvious advantages, there is still a need to contain the spherical grains inside the back volume by use of a mesh or vent wall that is sound transparent. Additionally, the manufacturing processes required for this particular method, including placing the grains of zeolite material into the back volume, can be intricate and expensive. The alternative of using a container has the same disadvantages as disclosed above.

Gas adsorbing material has typically not been used in microphones, balanced armature receivers or other similar miniaturized acoustic transducer applications because the prior art methods have been inadequate or cost prohibitive given the much smaller available back volume spaces in those devices. Whereas U.S. Pat. Publ. No. 2013/0170687 A1 discloses a commercially available micro-loudspeaker having a back volume that measures 1 $cm^3$, the entire volume of most balanced armature receivers used in in-ear earphones and hearing aids is less than one quarter of that size. And the available space into which gas adsorbing material could be added is a fraction of that small total space.

There is a desire therefore to provide the maximum possible adsorbency of a gas adsorbing material within the available space for a loudspeaker back volume within a mobile device. There is a further desire to use gas adsorbing materials to enhance the performance of acoustic transducers other than loudspeakers, such as microphones and balanced armature receivers which typically have even less space available to act as a back volume.

SUMMARY OF THE INVENTION

Therefore, it is an object of the present invention to overcome the problems of the prior art and provide a gas adsorbing material that has a greater adsorbency than the prior art in a given back volume. It is a further object to provide a gas adsorbing material having greater adsorbency by creating a molded gas adsorber made from a plurality of spheres comprising gas adsorbing porous particles and a binder. It is another object of the present invention to provide a gas adsorbing material that can provide the desired absorbency in smaller back volumes within acoustic transducers, such as loudspeakers, microphones and balanced armature receivers. It is still a further object to provide a gas adsorbing material in the form of an adsorbent coating capable of being applied to the internal surfaces of a back volume space within an acoustic transducer device.

According to an embodiment of the invention, there is provided a molded gas adsorber material that can be shaped to fit within the space available as a back volume for a loudspeaker in a mobile device. The gas adsorber material comprises a plurality of spheres and a binder that causes the spheres to stick together at adjacent contact points. In this way, the spheres create a matrix structure, with air channels existing between the spheres to allow air to access the internal spheres, and thus the surfaces of the porous particles within all of the spheres. In an embodiment, the sphere matrix can be molded prior to curing the binder into three-dimensional arbitrary shapes to fit specific applications such as the back volume in a particular mobile phone device. The finished molded shape can easily be inserted into the available back volume space during manufacturing.

According to an embodiment, the general process for forming the molded sphere matrix starts with a cavity mold conforming to the shape of the available back volume inside the structure of the acoustic device or within a suitable tool with the same structure as the intended acoustic device. The cavity is filled with a plurality of spheres of a gas adsorbent material. While in the cavity, the spheres are exposed to organic solvent under pressure. The adsorbent material will adsorb the solvents. Next, a UV or temperature curable binder material, such as commercially available colloidal binders containing cellulose or polyurethane, is added to the material. The binder is then cured under a reduced pressure, allowing the adsorbed organic solvents to desorb, which in turn opens the adsorbent pore structures in the adsorbent material.

The spheres on the outer layer of the sphere matrix may have a relatively weaker attachment than the spheres on the interior of the matrix because the outer spheres will have fewer attachment points. Therefore, a sheath in the form of a coatable material can be provided to the outer spheres which can provide further mechanical robustness for outer spheres. The sheath must be air permeable, ideally comprising adsorbent materials to allow air access to the matrix with minimal impedance.

According to an embodiment of the invention, a gas adsorber material as disclosed in U.S. Pat. Publ. No. 2013/0170687 A1 having a spherical shape can be used as the spheres in the molded sphere matrix. The gas adsorbing material is a zeolite material comprising a plurality of zeolite particles having a silicon to aluminum mass ratio of at least 200. In further embodiments, the zeolite material comprises aluminum-free zeolite particles, e.g., zeolite particles in pure $SiO_2$ modification. The zeolite material further comprises a binder adhering the plurality of zeolite particles together and forming grains of zeolite material which are larger than a single zeolite particle. The addition of the binder, along with appropriate processing of the ingredients of the zeolite material, allows for the creation of spaces between the zeolite particles.

The individual zeolite particles within the zeolite material have a mean diameter below 10 micrometers and above 0.1 micrometers. In other embodiments, the zeolite particles have a mean diameter below 2 micrometers. The grains of zeolite material, comprised of the plurality of particles and the binder, have an average grain size in a range between 0.2 millimeter and 0.9 millimeter. The zeolite particles have intrinsic internal pores with a diameter typically between 0.4 nm and 0.7 nm, with the lower limit being about the size of a nitrogen molecule. Within the zeolite material, second pores are formed between the zeolite particles, the second pores having a diameter of about 1 to 10 micrometers. In other embodiments, the zeolite particles are processed so that a second set of pores, called macropores, are formed in the zeolite particles and have a pore diameter larger than the intrinsic internal pores. In an embodiment, the macropores have a diameter in the range of 1 micrometer to 10 micrometers.

In other embodiments, the gas adsorbing material forming the individual spheres in the molded spherical matrix can be another highly porous material such as activated carbon, Silica, SiO2, Alumina Al2O3, Zirconia ZrO3, Magnesia (MgO), carbon nanotubes and fullerene.

In an embodiment, the gas adsorbing material may include spheres having different diameters, such as two different diameters. For example, the gas adsorbing material may including spheres of at least two different diameters.

In embodiments, the matrix of gas adsorbing material may have one or more linear channels into or through the matrix to expedite airflow into the matrix. Such channels may be formed, for example, by forming the matrix around one or more linear appendages or members and removing the one or more linear appendages or members once the matrix is formed.

According to another embodiment of the invention, there is provided an adsorbent coating comprising an adsorbent material and a coating material. The adsorbent material is a highly porous material such as activated charcoal, Silica, $SiO_2$, Alumina $Al_2O_3$, Zirconia $ZrO_3$, Magnesia (MgO), zeolites, carbon nanotubes and fullerene. The coating material is chosen from the list of paint, laminate, plating material and similar coating material.

In an embodiment, the adsorbent material in the adsorbent coating is comprised of loose particles of a highly porous material. In such case, the adsorbent coating is applied to the surface of a back volume at a thickness that avoids compaction of the loose particles. The thickness is dependent in part on the size of the loose particles of the highly porous material.

In an embodiment, the adsorbent material comprises a plurality of grains of an adsorbent material, with each grain comprising a plurality of particles of a highly porous material and a binder. The plurality of grains are prepared and cured prior to mixing with the coating material. Within each grain, the binder creates spaces between individual particles of the highly porous material. In this embodiment, the adsorbent coating can be applied to the surface of a back volume without any concern that the particles in the adsorbent material will become compacted due to the spacing provided by the binder.

In a further embodiment, the coating material further comprises a binding agent and the adsorbent material comprises loose particles of a highly porous material. The binding agent in the coating material functions similarly to the binder in the grains of an adsorbent material by creating spaces between individual particles. The adsorbent coating can be applied to the surface walls of a back volume without regard that the particles will become compacted if the coating is too thick when applied.

In one embodiment, the adsorbent coating comprises an adsorbent material and a coating material. The coating material is in a form selected from a paint, a laminate and a plating material. The adsorbent coating is applied to the desired internal surfaces of a back volume for an acoustic transducer. In an embodiment, the viscosity of the adsorbent coating is adjusted based on the desired final thickness of the coating on the internal surfaces of the back volume. In a further embodiment, the adsorbent coating is cured by being subjected to heat at an appropriate temperature for an appropriate time.

In another embodiment, the adsorbent coating comprises an adsorbent material and a coating material. The coating material comprises an inert binder, such as calcium sulfate (gypsum) and water. The mixture of adsorbent material, binder and water is applied as a thick slurry on the desired internal surfaces of the back volume for the acoustic transducer device. The structure forming the back volume is made from a non-reactive material. After the coating material is applied, it is activated by heating in an oven for thirty minutes at 110° C.

In an embodiment, the adsorbent coating comprises an adsorbent material, a coating material and a pore-forming agent such as tartaric acid. The pore-forming agent is used to promote the formation of additional pores in the adsorbent coating material, which is particularly useful in situations where the coating material fills in or clogs any pores in the adsorbing material.

Both the molded sphere matrix arrangement of a gas adsorber and the adsorbent coating material have several advantages over the prior art applications of using gas adsorbing material in an acoustic transducer device. For example, there is no need for external packaging for the gas adsorber because there are no loose particles in either application. Further, the spheres in the molded sphere matrix are held together by the binder and particles in the adsorbent material are bound within the coating material. For the same reason, there is no need for the mesh or vent wall that is required with the method of direct filling the back volume space with spherically shaped grains.

Without the need for external packaging or a mesh wall, more gas adsorbent material can be fit within the available back volume space by using the disclosed molded sphere matrix arrangement or by applying an adsorbent coating to the internal services, thus increasing the overall adsorbence of the gas adsorbing material. Molding the sphere matrix into a shape to fit the specific application can also allow for more material to fit into the available space than when using the direct fill method where final placement of the spheres is not always controllable. Both the molded sphere matrix and the adsorbent coating also allows for placement of gas adsorbing material in spaces where the direct fill method does not work particularly well.

The invention further relates to an acoustic device, including a loudspeaker, microphone or balanced armature receiver, having a back volume space and including either a molded sphere matrix arrangement as described above included in the loudspeaker back volume of the device or an adsorbent coating applied to the internal surfaces of the back volume space. The invention also relates to a mobile device or hearing apparatus, such as a wireless phone, a tablet a laptop, a hearing aid or in-ear earphones, which includes one or more of such acoustic devices.

The use of the molded sphere matrix and/or the use of an adsorbent coating as a gas adsorbing material both have another advantage over the prior art in that it allows for the placement of a gas adsorbing material in applications where the available back volume space is even smaller than for loudspeakers in mobile devices. In particular, the both the molded sphere matrix and the adsorbent coating provides the ability to fill the smaller back volumes available in microphones, hearing aids and in-ear earphones. Balanced armature receivers are frequently utilized for hearing aids and in-ear earphones because of their performance capabilities and small form factor. However, known gas adsorbing materials and methods have not been used with balanced armature receivers due to the relatively small back volume space in those devices. The addition of a gas adsorbing material, either as the described molded sphere matrix or the adsorbent coating will improve the acoustic performance of the device.

Additionally, an adsorbent coating is particularly useful in back volume configurations that include narrow channels due to the space constraints within a mobile device. Narrow channels between spaces used as a back volume for an acoustic transducer device pose difficulties for gas adsorbing material in packaging, particularly due the amount of space in the channel consumed by the packaging. Further, when direct filling spherically-shaped grains of adsorbent material into a back volume, narrow channels can impede the flow of the grains.

The foregoing and other aspects, features, details, utilities, and advantages of the present invention will be apparent from reading the following description and claims, and from reviewing the accompanying drawings.

BRIEF DESCRIPTION OF THE DRAWINGS

Further embodiments of the invention are indicated in the figures and in the dependent claims. The invention will now be explained in detail by the drawings. In the drawings:

DETAILED DESCRIPTION OF THE INVENTION

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Figure 1:
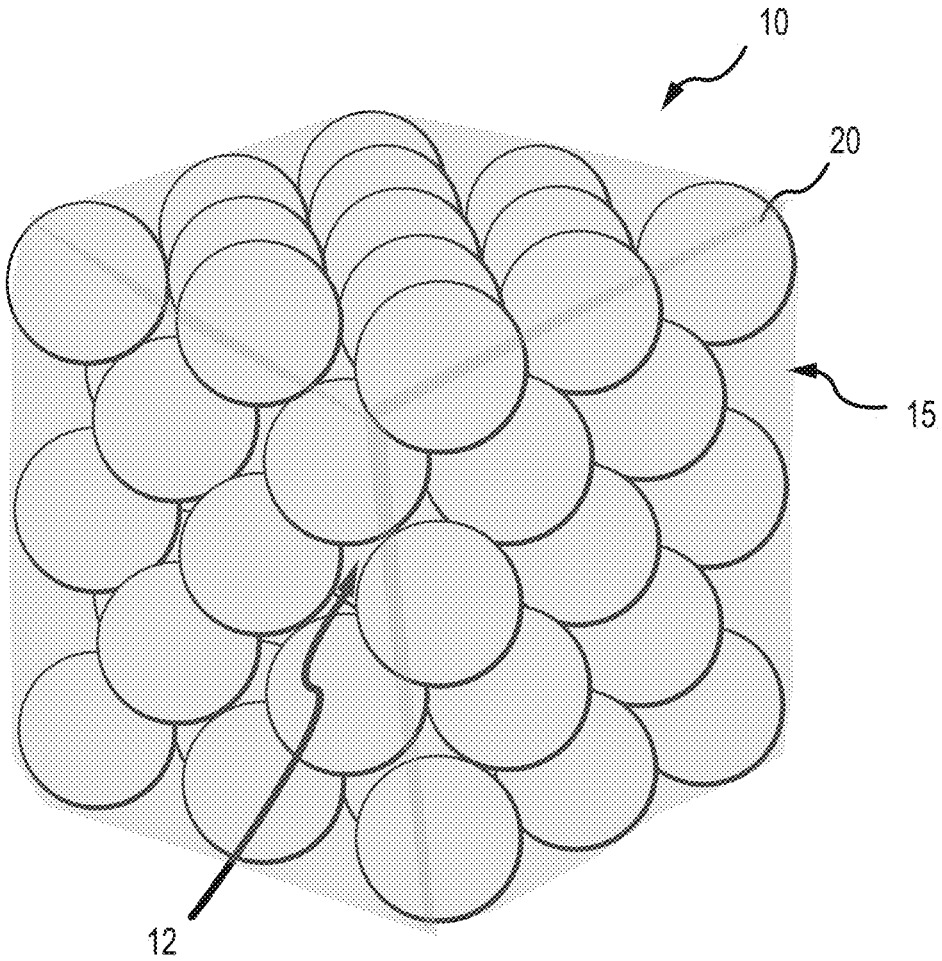
FIG. 1 depicts a molded sphere matrix of a gas adsorbing material according to one aspect of the invention.

FIG. 1 shows a molded sphere matrix 10 of a gas adsorbing material according to one embodiment. The molded sphere matrix 10 is comprised of a plurality of individual spherically shaped grains 20 of gas adsorbing material. Each of the plurality of the spherically shaped grains 20 in the molded sphere matrix 10 is coated with a binder (not shown) causing each of the spherically shaped grains 20 to stick to each of the other spherically shaped grains 20 that it is adjacent to in the molded sphere matrix 10. Because of the spherical shape of the grains 20, air channels 12 are created between the grains 20 within the sphere matrix 10. The air channels 12 allow air to access the spherically-shaped grains located internal in the sphere matrix 10, and thus the surfaces of the porous particles within all of the spherically shaped grains 20.

Figure 2:
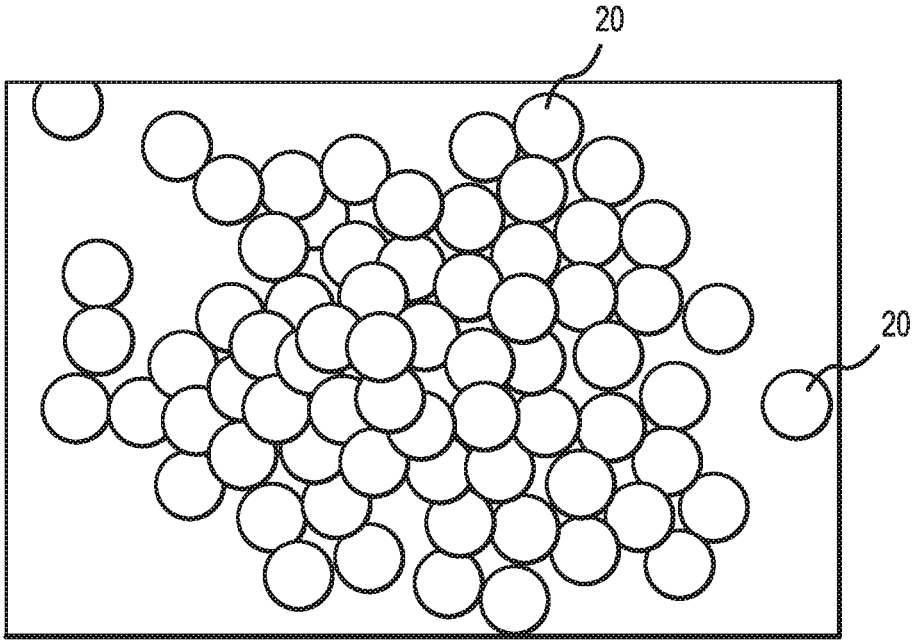
FIG. 2 depicts one embodiment of the spherically shaped grains of a gas adsorbing material that forms the molded sphere matrix of FIG. 1.

FIG. 2 shows the plurality of individual spherically shaped grains 20 of gas adsorbing material without being adhered to each other in the molded sphere matrix 10 of FIG. 1.

Figure 3A:
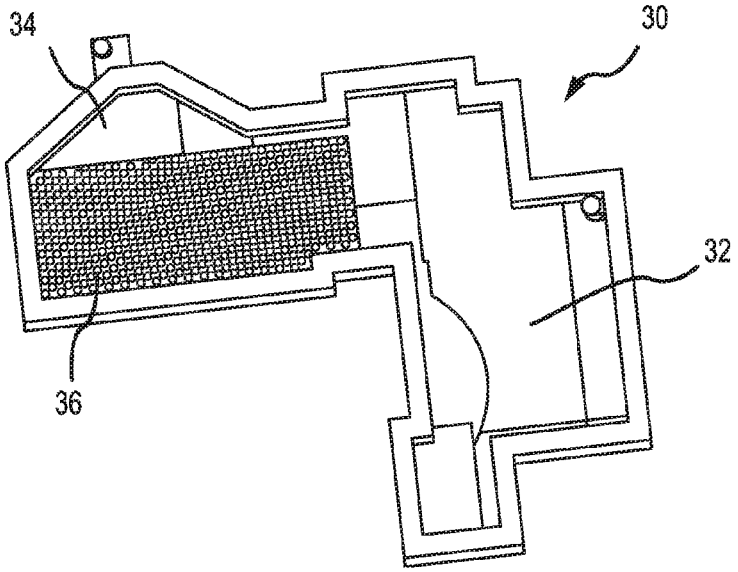
FIG. 3*a* depicts a loudspeaker enclosure for a mobile device containing a molded sphere matrix of a gas adsorbing material according to one aspect of the invention.
Figure 3B:
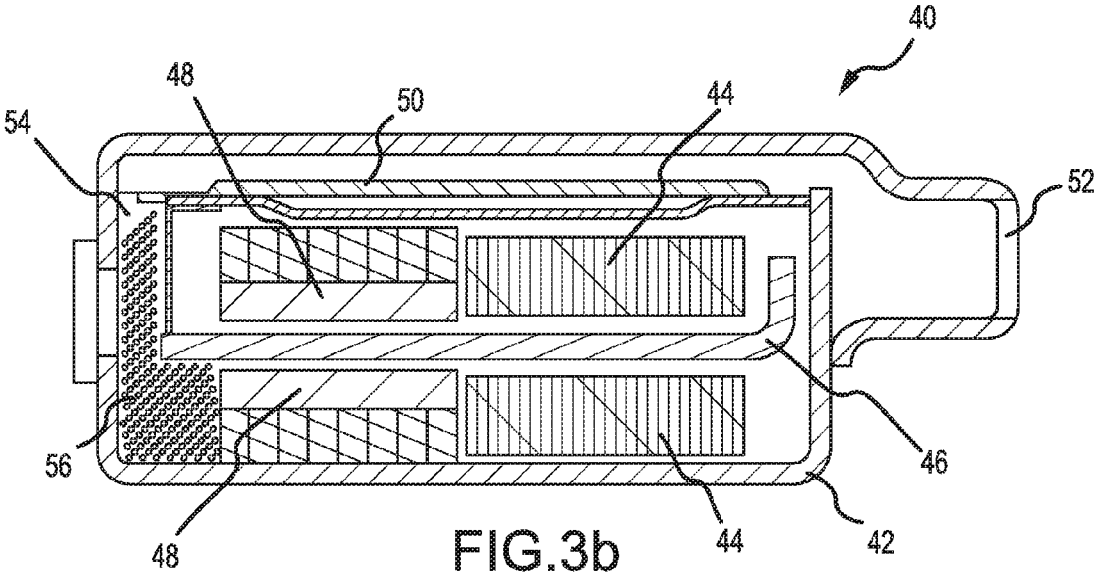
FIG. 3*b* depicts a balanced armature receiver having located therein a molded sphere matrix of a gas adsorbing material according to one aspect of the invention.

FIGS. 3*a* and 3*b* show two applications of the molded sphere matrix 10 having different shapes. FIG. 3*a* is a top view of a loudspeaker enclosure 30. The loudspeaker enclosure 30 includes a loudspeaker receptacle space 32, and a back volume space 34. Molded sphere matrix 36, the same as matrix 10 except for its shape, is shaped to conform with the back volume space 34.

FIG. 3*b* shows a sectional view of a balanced armature receiver 40. The balanced armature receiver 40 includes a case 42, coil 44, armature 46, magnets 48, membrane 50 and sound outlet 52. Within the case 42, and on the back-side of membrane 50, is a back volume space 54. Molded sphere matrix 56, the same as matrix 10 except for the shape, is molded to conform to the back volume space 54.

The process to form a molded sphere matrix 36, 56, as shown in FIGS. 3*a* and 3*b*, or any other application, starts with a cavity mold conforming to the shape of the available back volume space 34, 54 inside the structure of the acoustic device. For the loudspeaker enclosure 30 and balanced armature receiver 40 in FIGS. 3*a* and 3*b*, the cavity mold would conform to the back volume spaces 34, 54 as shown. The cavity mold is filled with a plurality of spherically shaped grains 20 of a gas adsorbent material. While in the cavity, the spherically shaped grains 20 are exposed to organic solvent under pressure. The adsorbent material will adsorb the solvents. Next, a UV or temperature curable binder material, such as commercially available colloidal binders containing cellulose or polyurethane, is added to the spherically shaped grains 20 inside the cavity. The binder is then cured under a reduced pressure, allowing the adsorbed organic solvents to desorb, which in turn opens the adsorbent pore structures in the spherically shaped grains 20. The molded sphere matrix 36, 56 is then removed from the cavity mold and is in the desired shape for placement into an acoustic device 30, 40.

The spherically shaped grains 20 on the outside layer of the molded sphere matrix 10 may have a relatively weaker attachment to the matrix because they have fewer attachment points. As shown in FIG. 1, a sheath 15 in the form of a coatable material may therefore be provided to the outer spherically shaped grains 20. The sheath 15 provides further mechanical robustness for attachment of the outer layer of spherically shaped grains 20. The sheath 15 is an air permeable adsorbent sheath that allows air to access the molded sphere matrix 10 with minimal impedance.

Figure 4:
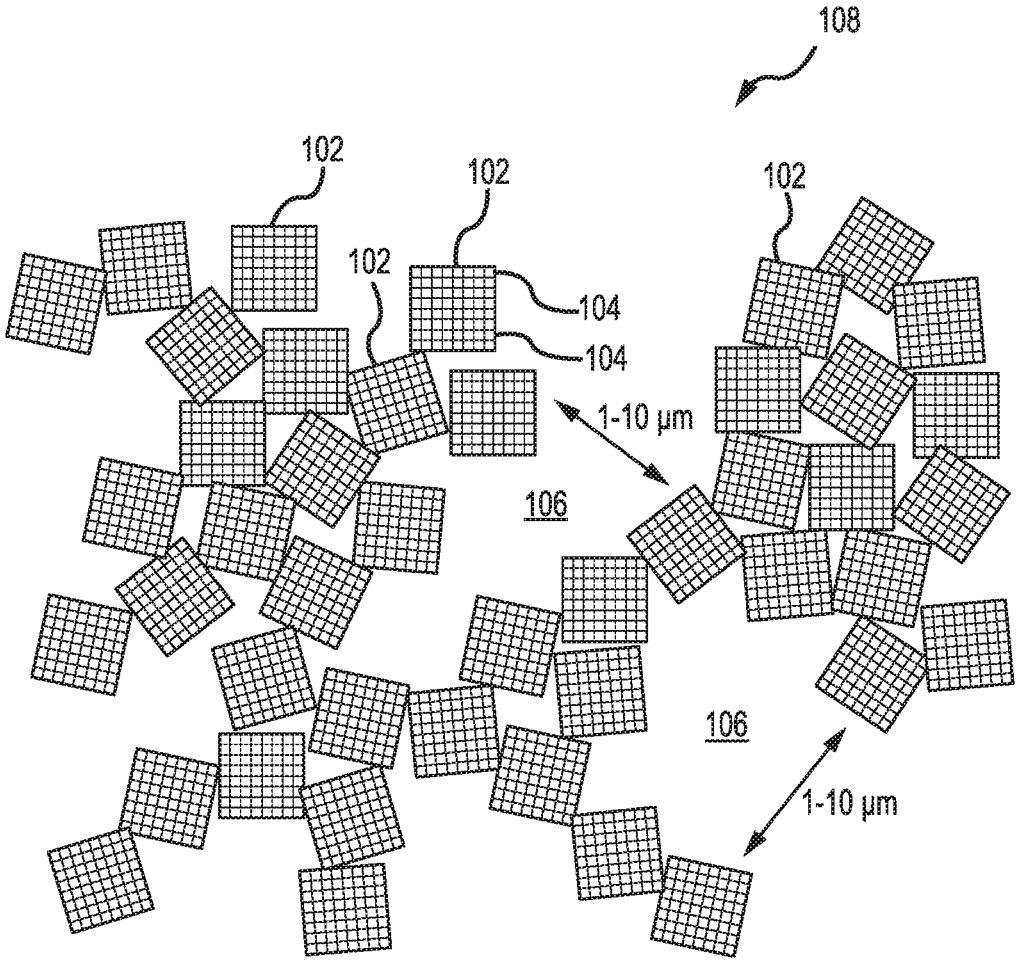
FIG. 4 schematically shows a grain of a gas adsorbing material in accordance with embodiments of the invention.

Many different gas adsorbing materials are suitable to use for the spherically shaped grains 20, including activated carbon, silica, $S_iO_2$, Aluminum $Al_2O_3$, Zirona $ZrO_3$; Magnesium (MgO), zeolites, carbon nanotubes and fullerene. The zeolite material disclosed in U.S. Pat. Publ. No. 2013/0170687A1 with a silicon to aluminum mass ratio of at least 200 has a spherical shape and is particularly useful in the spherically shaped grains 20. FIG. 4 shows a molded grain 108 of zeolite material that can be used to form the spherically shaped grains 20 of gas adsorbing material in one embodiment. The molded grains 108 of zeolite material comprise a plurality of zeolite particles, some of which are denoted by 102 in FIG. 4. The zeolite particles 102 have internal first pores 104, indicated by the structure shown within the individual zeolite particles 102 shown in FIG. 4.

The zeolite particles 102 are adhered together with a binder (not shown in FIG. 4). In accordance with an embodiment of the herein disclosed subject matter, second pores 106 are formed within the molded grain 108 between the zeolite particles 102. In an exemplary embodiment, the second pores 106 have a diameter of about 1 to 10 micrometer, as indicated in FIG. 4. Due to the binder, the individual particles 102 in FIG. 4 are adhered together to form the molded grain 108.

It should further be mentioned that although the zeolite particles 102 are drawn with a rectangular shape in FIG. 4, the real zeolite particles 102 may have a different form which depends on the actual structure of the zeolite particles 102.

Figure 5:
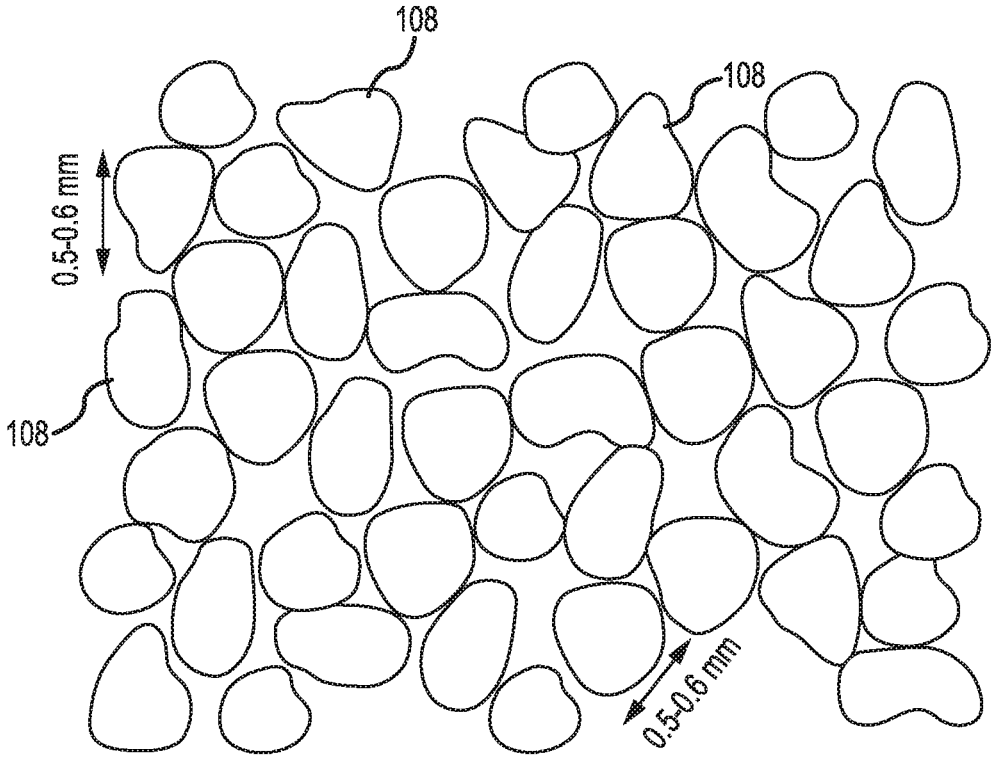
FIG. 5 schematically shows a shaped gas adsorbing material formed from the grains of FIG. 4 in accordance with embodiments of the invention.

FIG. 5 shows a plurality of molded grains 108 of the type shown in FIG. 4. As indicated in FIG. 5, the diameter of the molded grains 108 is about 0.5 mm to 0.6 mm in an embodiment. While the molded grains 108 are shown having non-uniform, non-standard shapes, it is understood that the grains can be molded into spheres, such as the spherically shaped grains 20 shown in FIGS. 1-2.

Figure 6:
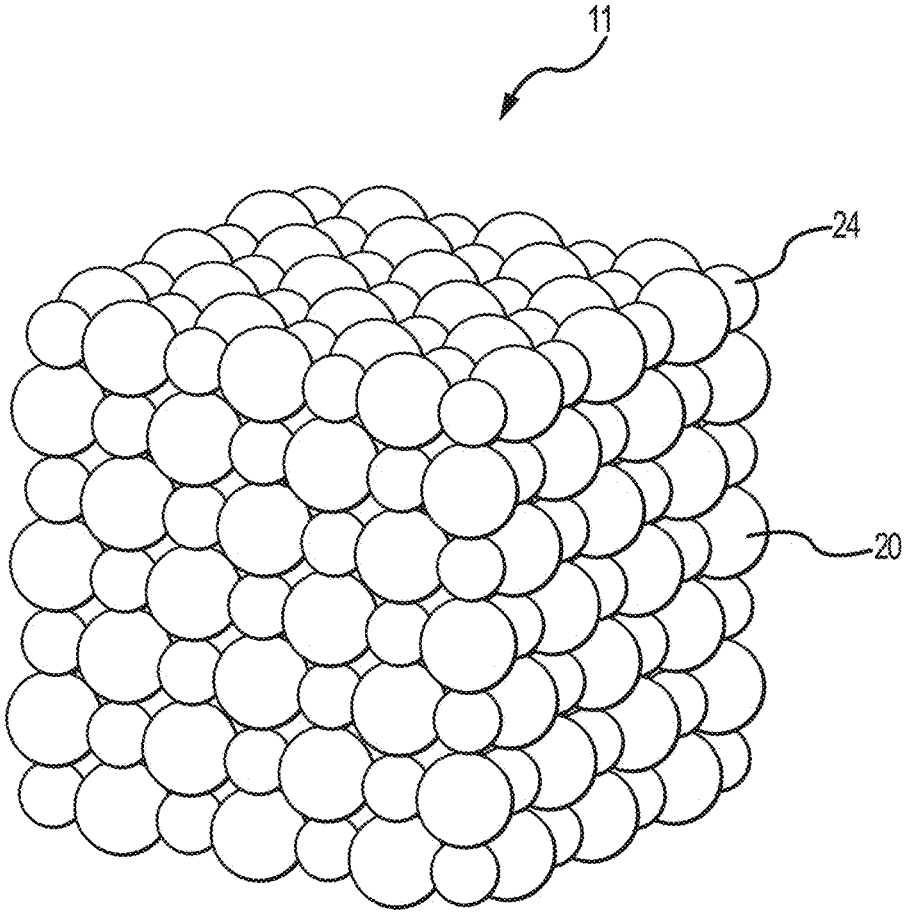
FIG. 6 depicts a molded sphere matrix of a gas adsorbing material according to another aspect of the invention.

The molded sphere matrix 10 of FIG. 1 shows a plurality of uniformly-sized spherically shaped grains 20. However the molded sphere matrix 20 may be formed using spherically shaped grains 20 of two or more different sizes. FIG. 6 depicts an embodiment of a molded sphere matrix 11 of gas adsorbing material having spherically shaped grains 20, 24 of different sizes. The spherically shaped grains 20, 24 may have different radii from each other, in embodiments. For example, the matrix may include spherically shaped grains of a plurality of different radii. For example, as illustrated in FIG. 6, the matrix may include spheres 20, 24 of two different radii.

The molded sphere matrix 11 may include a first set of spherically shaped grains 20 having a first radius and a second set of spherically shaped grains 24 having a second radius, in an embodiment. The second radius may be smaller than the first radius. The relative number of spherically shaped grains in the first set and the second set may be selected according to the needs of a particular embodiment. In one embodiment, the first set of spherically shaped grains 20 may have more spherically shaped grains than the second set of spherically shaped grains 24. In another, the second set of spherically shaped grains 24 may have more spherically shaped grains than the first set 20. Furthermore, the relative sizes (i.e., radii) of the first set and the second set 20, 24 may be selected according to the needs of a particular embodiment.

Although described above with two different spherically shaped grains sizes, a matrix of gas adsorbing material according to the present disclosure may have any number of different sizes of spherically-shaped grains (e.g., instead of two, the matrix may have three, four, or more different spherically-shaped grain sizes). The number of sphere sizes in the matrix, and the sizes of the spherically-shaped grains, may be selected according to the needs of a particular application.

A matrix of adsorbent material having spherically shaped grains of multiple sizes may provide numerous advantages. Providing two or more sizes of spherically-shaped grains may provide a better fill rate for a given space than a matrix including spherically-shaped grains of only a single size. Furthermore, a variety of different spherically-shaped grain sizes may allow for improved control over the adsorbent properties of the matrix, including control over the volume of the matrix (e.g., the volume occupied by the spherically-shaped grains of the matrix, as opposed to empty space) and therefore over the damping properties of the matrix. As a result, a matrix having numerous different spherically-shaped grain sizes may allow increased performance, increased ability to specifically tailoring the matrix to different sizes and shapes of the back volumes of different applications, and increased ability to specifically tailor the matrix properties to the performance needs of a particular type or design or a speaker or other device.

Figure 7A:
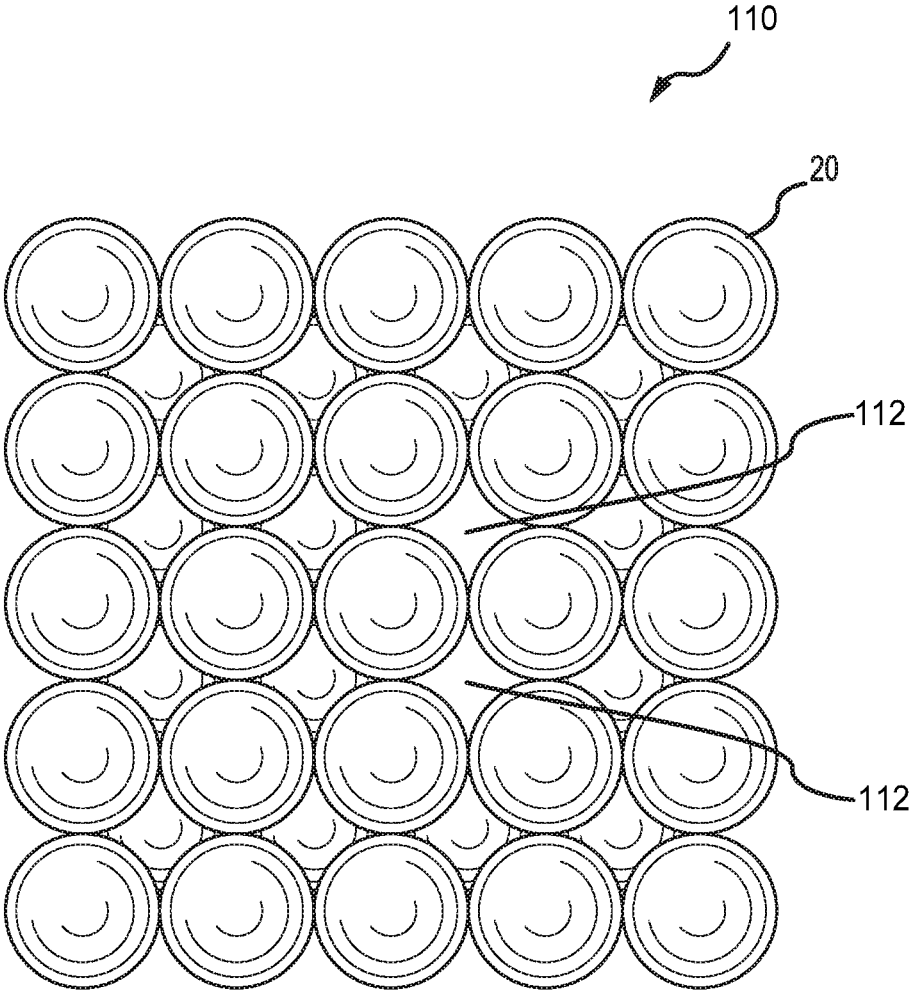
FIGS. 7*a* and 7*b* are diagrammatic isometric views of an embodiment of a molded sphere matrix, illustrating air flow channels that may be provided for entry of air into the matrix.
Figure 7B:
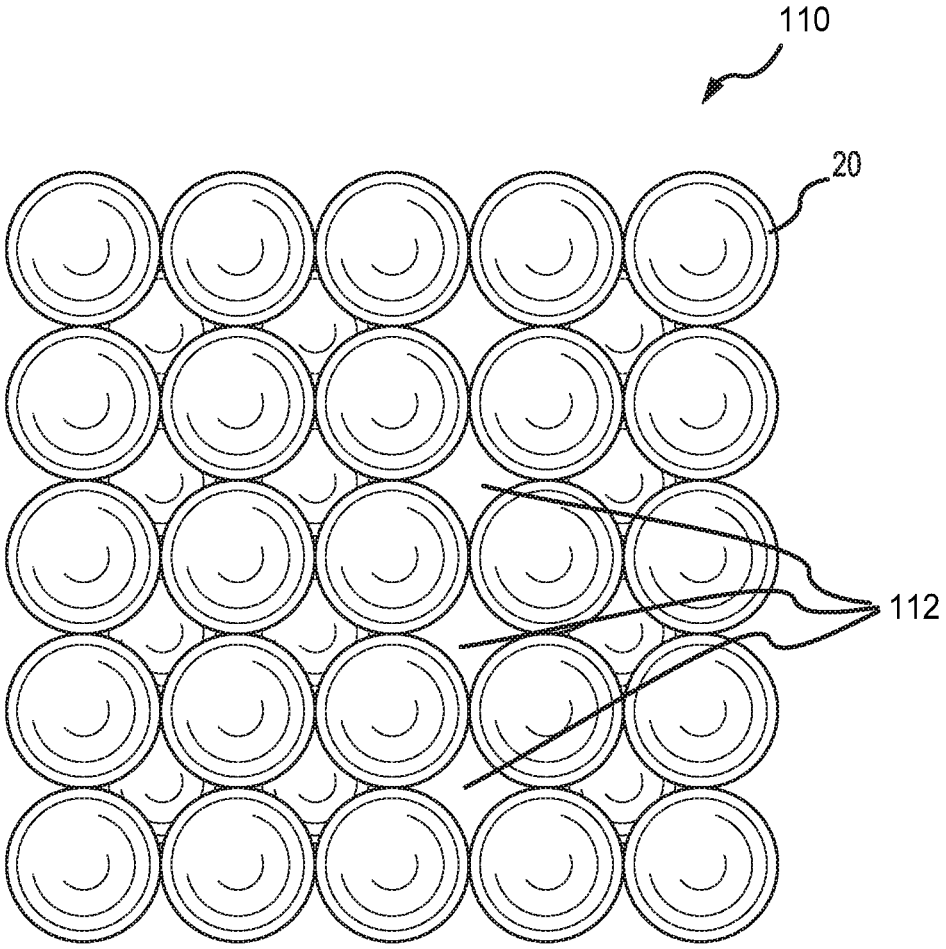

FIGS. 7*a* and 7*b* are diagrammatic isometric views of an embodiment of a molded sphere matrix 110 having channels 112 created through the molded sphere matrix 110 for improved airflow. A side view of molded sphere matrix 110 is shown in FIG. 7*a* and a top view is shown in FIG. 7*b*. The molded sphere matrix 110, as illustrated, includes channels 112 into and through the molded sphere matrix 110 for admitting airflow into the molded sphere matrix 110 in an efficient manner. The channels 112 may be formed into any side of the molded sphere matrix 110, in embodiments. Any single channel 112 may extend entirely through the molded sphere matrix 110, or may terminate within the matrix, in embodiments. For example, a channel 112 may extend continuously, substantially linearly, through a plurality of layers of the matrix. Any number of channels 112 may be provided into or through the matrix, in embodiments, depending on the needs of a particular application. Furthermore, in addition to or instead of channels 112 through the interior of the matrix, channels may be provided along the outer surface of the matrix (i.e., in the form of continuous linear indentations on the exterior of the molded sphere matrix 110).

Channels 112 may be formed, in an embodiment, by adding one or more appendages or members in the cavity mold and forming the matrix around them. The appendages or members can be removed after the spherically shaped grains are bonded to each other, thus forming the channels 112.

The spherically-shaped grains 20 of a gas adsorbing material described herein is also particularly useful as part of an adsorbent coating, also described herein. The adsorbent coating is comprised of a coating material and a plurality of spherically-shaped grains 20. The coating material can be a paint, laminate, plating material or other similar coating material capable of mixing with the spherically-shaped grains 20. The coating material, however, should be designed not to clog the pores within the adsorbent material particles of the in the spherically-shaped grains 20.

Figure 8:
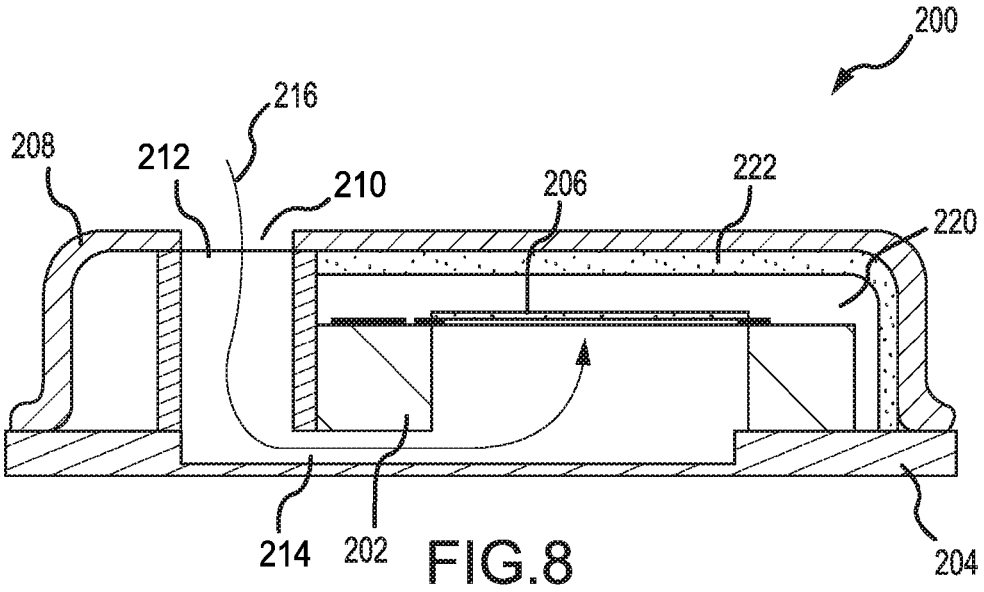
FIG. 8 depicts a top-ported MEMS microphone with an adsorbent coating according to one aspect of the invention applied to the internal surfaces of a back volume.

FIG. 8 shows a top ported MEMS microphone 200 as disclosed in U.S. Pat. Publ. No. 2013/0051598 A1, the entire disclosure of which is incorporated by reference in its entirety herein. The MEMS microphone 200 comprises a MEMS die 202 mounted on a laminate base 204. The MEMS the 202 has a membrane 206. A cap 208 covers the whole assembly, the cap 208 including an acoustic inlet port 210. A nozzle 212 connects the inlet port 210 with a channel 214 formed in the side wall of the MEMS die 202. The inlet port 210, nozzle 212 and channel 214 form a sound path 2016 from the outside to a chamber 218 defined in part by the front side of membrane 206. The back side of membrane 206 faces a sealed back volume 220. An adsorbent coating 222 according to one embodiment is applied to the internal surfaces of the back volume 220 in the MEMS microphone 200.

Figure 9:
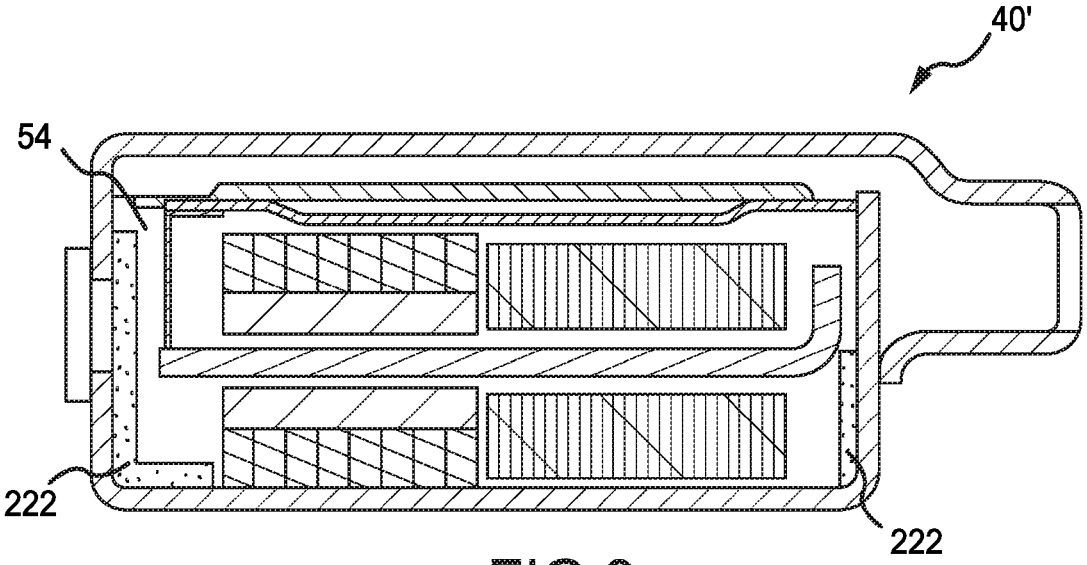
FIG. 9 depicts a balanced armature receiver having containing an adsorbent coating according to one aspect of the invention.

FIG. 9 shows another application for the adsorbent coating 222, where it is applied to the internal surfaces of the back volume space 54 of a balanced armature receiver 40', which is otherwise identical to the balanced armature receiver 40 of FIG. 3*b*.

In closing, it should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application.

What is claimed is:

1. A gas adsorbing matrix structure for use in an acoustic device, the gas adsorbing matrix structure comprising:

a plurality of spherically-shaped grains of a gas adsorbing material; and a binder coating disposed on each of the spherically-shaped grains, wherein the plurality of spherically-shaped grains are arranged together in a matrix configuration, the matrix being shaped to correspond to a volume in the acoustic device, and wherein the binder coating affixes each of the spherically-shaped grains to the adjacent spherically-shaped grains in the matrix.

2. The gas adsorbing matrix structure of claim 1, wherein the gas adsorbing material is a zeolite.

3. The gas adsorbing matrix structure of claim 2, wherein the zeolite has a silicon to aluminum mass ratio of at least 200.

4. The gas adsorbing matrix structure of claim 1, wherein the gas adsorbing material is one of activated charcoal, Silica, Alumina, Zirconia, Magnesia, carbon nanotubes and fullerene.

5. The gas adsorbing matrix structure of claim 1, wherein the acoustic device is a loudspeaker and the volume in the acoustic device is a back-volume.

6. The gas adsorbing matrix structure of claim 1, wherein the binder coating is a UV or temperature curable binder material.

7. The gas adsorbing matrix structure of claim 1, further comprising an air permeable adsorbent sheath provided around the outside of the gas adsorbing matrix structure, the air permeable adsorbent sheath being configured to provide support to hold in place the spherically-shaped grains located on the outer layer of the gas adsorbing matrix structure.

8. The gas adsorbing matrix structure of claim 1, wherein the plurality of spherically-shaped grains have substantially the same diameter.

9. The gas adsorbing matrix structure of claim 1, wherein the plurality of spherically-shaped grains comprises a first set of spherically-shaped grains having substantially the same first diameter, and a second set of spherically-shaped grains having substantially the same second diameter, wherein the first diameter is different from the second diameter.

10. The gas adsorbing matrix structure of claim 1, wherein the plurality of spherically-shaped grains comprises a plurality of sets of spherically-shaped grains, wherein the spherically-shaped grains within each set has a substantially uniform diameter, and the substantially uniform diameter within each set of spherically-shaped grains is different from the substantially uniform diameter within the other sets of spherically-shaped grains.

11. The gas adsorbing matrix structure of claim 1 further comprising at least one substantially linear aperture extending from a first side of the gas adsorbing matrix structure to a second side of the gas adsorbing matrix structure, the second side being opposite the first side, the at least one aperture being configured to provide a substantially linear air path through the gas adsorbing matrix structure.

12. The gas adsorbing matrix structure of claim 1 further comprising at least one substantially linear aperture extending from the outside of the gas adsorbing matrix structure through a plurality of layers of the matrix, wherein the at least one aperture is configured to provide a substantially linear air path into the gas adsorbing matrix structure.

13. An acoustic device comprising:

a housing;

a back volume located within the housing; and a gas adsorbing matrix structure located within the housing, the gas adsorbing matrix structure having a three-dimensional shape that substantially conforms to the shape of the back volume and comprising:

a plurality of spherically-shaped grains of a gas adsorbing material; and a binder coating disposed on each of the spherically-shaped grains, wherein the plurality of spherically-shaped grains are arranged together in a matrix configuration, and wherein the binder coating affixes each of the spherically-shaped grains to the adjacent spherically-shaped grains in the matrix.

* * * * *